US006300915B1

(12) United States Patent
Lopez

(10) Patent No.: US 6,300,915 B1
(45) Date of Patent: Oct. 9, 2001

(54) VERTICAL ARRAY ANTENNAS FOR DIFFERENTIAL GPS GROUND STATIONS

(75) Inventor: Alfred R. Lopez, Commack, NY (US)

(73) Assignee: Bae Systems Aerospace Inc. Advanced Systems, Greenlawn, NY (US)

( * ) Notice: Subject to any disclaimer, the term of this patent is extended or adjusted under 35 U.S.C. 154(b) by 0 days.

(21) Appl. No.: 09/709,136

(22) Filed: Nov. 9, 2000

(51) Int. Cl.[7] ..... H01Q 21/12

(52) U.S. Cl. ..... 343/813; 343/799; 343/810; 343/891

(58) Field of Search ..... 343/810, 812, 343/813, 815, 890, 891, 893, 797, 853, 799

(56) References Cited

U.S. PATENT DOCUMENTS 5,534,882 7/1996 Lopez ..... 343/891
6,025,812 * 2/2000 Gabriel et al. ..... 343/797
6,028,563 * 2/2000 Higins ..... 343/797
6,201,510 * 3/2001 Lopez et al. ..... 343/799

* cited by examiner

*Primary Examiner*—Tan Ho
(74) *Attorney, Agent, or Firm*—Edward A. Onders; Kenneth P. Robinson

(57) ABSTRACT

For broadcast transmission of Differential GPS data signals, a vertical array antenna provides broad band omnidirective phase-progressive radiation with elliptical polarization. Four-dipole sub-arrays use diagonally aligned two-piece cut and bend dipoles with isolated conductive frontal strip. With these vertically arrayed sub-arrays, lower and upper sub-arrays are excited at 70 percent amplitude and respective plus and minus 90 degree phase rotation relative to middle sub-array, for optimized performance with low elevation lobing. Divided transmission line operation provided by the frontal strip of appropriate length achieves double-tuned dipole performance with very low VSWR over the operating band.

22 Claims, 6 Drawing Sheets

VERTICAL ARRAY ANTENNAS FOR DIFFERENTIAL GPS GROUND STATIONS

RELATED INVENTIONS (Not Applicable)

FEDERALLY SPONSORED RESEARCH (Not Applicable)

BACKGROUND OF THE INVENTION

This invention relates to antennas to broadcast VHF data from a differential GPS ground station to supplement GPS reception for aircraft landings and, more generally, to elliptically-polarized omnidirective phase-progressive sub-arrays, vertical array antennas including a plurality of such sub-arrays, and cut-and-bend dipoles usable in such sub-arrays.

Enhanced accuracy applications of Global Positioning System (GPS) signals, such as use in aircraft landing and local control operations, can be enabled by derivation and local broadcast of Differential GPS (DGPS) signals to permit in-aircraft correction of local and other errors inherent in basic GPS signals. These errors may include ionospheric, tropospheric and satellite clock and ephemeris errors. To provide such DGPS signals, accurate local reception of GPS satellite signals is followed by derivation and local broadcast of the DGPS signals.

For such GPS signal reception, antenna systems providing a circular polarization characteristic in all directions horizontally and upward from the horizon, with a sharp cut-off characteristic below the horizon are described in U.S. Pat. No. 5,534,882, issued to the present inventor on Jul. 9, 1996, which is hereby incorporated herein by reference. Antennas with such characteristics are particularly suited to reception of signals from GPS satellites.

For local broadcast of DGPS data signals at VHF frequencies (e.g., for FAA Local Area Augmentation System (LAAS) for VHF Data Broadcast (VDB) applications) different antenna performance is required. Particular antenna requirements and characteristics may include accurate and reliable omnidirective broadcast of elliptically polarized VHF data signals, with elevation gain uniformity. Signal fades caused by ground reflections must also be minimized.

Objects of the present invention are, therefore, to provide new and improved antennas usable for such applications, and antennas, dipole arrays and cut-and-bend dipoles having one or more of the following characteristics and advantages:

- omnidirective elliptical polarization;
- omnidirective phase-progressive radiation;
- low VSWR VHF band coverage via double-tuned dipoles:
- optimized sub-array excitation for low elevation lobing;
- dipoles with isolated frontal conductor for double-tuned performance;
- frontal divided transmission line structure for double tuning, provided via frontal conductor;
- low cost cut-and-bend construction; and
- economical and reliable dipole construction consisting basically of only two sheet-metal strips.

SUMMARY OF THE INVENTION

In accordance with the invention, a vertical array antenna, including a plurality of four-dipole sub-arrays, comprises a support mast aligned vertically, lower, middle and upper sub-arrays and an excitation arrangement. Each sub-array includes four dipoles extending from the mast at 90 degree azimuth separations, with each dipole comprising:

(a) left and right conductive L-shaped strips having (i) respective left and right parallel portions extending outward from the mast in parallel spaced adjacent relation and (ii) left and right arm portions extending laterally from the respective parallel portions, oppositely from each other and diagonally to horizontal, and (b) a conductive frontal strip extending in parallel spaced adjacent relation to a portion of the combined length of said left and right arm portions to form a frontal divided transmission line structure. The excitation arrangement is coupled to intermediate points along the parallel portions of the L-shaped strips of each dipole to provide omnidirective phase-progressive excitation of each sub-array, with (i) the middle sub-array having phase-progressive excitation of reference amplitude and phase, (ii) the lower sub-array having phase-progressive excitation of nominally 70 percent amplitude and plus 90 degrees phase rotation relative to the reference amplitude and phase, and (iii) the upper sub-array having phase-progressive excitation of nominally 70 percent amplitude and minus 90 degree phase rotation relative to the reference amplitude and phase.

Also in accordance with the invention, a cut-and-bend dipole includes two L-shaped strips and a conductive frontal strip. The first L-shaped conductive strip has a first portion extending from a mounting portion outward and an arm portion bent normal to the first portion. The second L-shaped conductive strip has a parallel portion extending from a mounting portion outward in parallel spaced adjacent relation to the first portion and an arm portion bent normal to the parallel portion and extending oppositely from the arm portion of the first L-shaped strip. The conductive frontal strip extends in parallel spaced adjacent relation to a portion of the combined length of the oppositely extending arm portions to form a frontal divided transmission line structure. The strips may be formed from sheet stock, with each L-shaped strip having a normal bend to provide an arm portion.

For economical and reliable construction, of such a dipole, the first and second L-shaped conductive strips may be formed in one continuous strip with the first portion and parallel portion bent normal to a bridging section, which connects those portions and comprises the mounting portion. Typically, the frontal strip extends linearly in front of nominally 80 percent of the combined length of the oppositely extending arm portions and is dielectrically supported in centered relation to that combined length.

For a better understanding of the invention, together with other and further objects, reference is made to the accompanying drawings and the scope of the invention will be pointed out in the accompanying claims.

DESCRIPTION OF THE INVENTION

Figure 1:
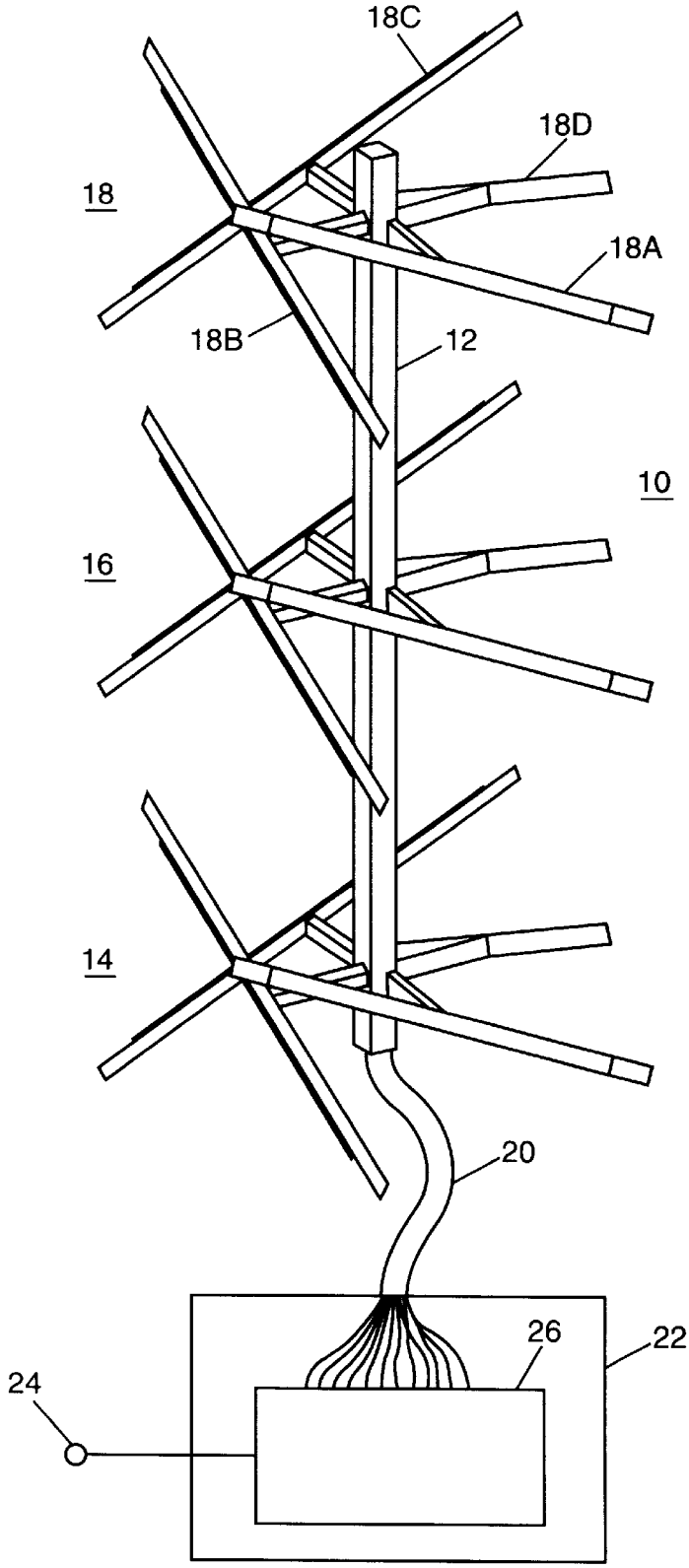
FIG. 1 is an oblique view of a vertical array antenna with three vertically-spaced sub-arrays each including four dipoles mounted at 90 degree azimuth separations and having arms extending diagonally at 25 degrees to horizontal.

FIG. 1 illustrates an embodiment of a vertical array antenna 10, including a plurality of four-dipole sub-arrays, in accordance with the invention. The antenna 10 includes a support mast 12 aligned vertically and respective lower, middle and upper sub-arrays 14, 16, 18. As shown, each sub-array includes four dipoles (e.g., dipoles 18A, 18B, 18C, 18D of sub-array 18) extending from mast 12 at 90 degree azimuth separations. In this example, the oppositely extending arms of each dipole are aligned along a line inclined at an angle of 25 degrees to horizontal, to provide an elliptical phase-progressive radiation pattern. Physical details of the individual dipoles are better illustrated in FIGS. 4, 5 and 6 and will be described with reference thereto. In FIG. 1, array antenna 10 further includes an excitation arrangement comprising a twelve-line cable 20, excitation unit 22 and input port 24. Excitation unit 22 is illustrated as including a signal splitter/phasing unit 26, which may be arranged using known techniques to split a signal input at port 24 into twelve signals of phase and amplitude appropriate to feed the twelve dipoles of the array antenna 10 to provide desired respective phases and amplitudes of excitation. The excitation arrangement will typically include individual transmission line sections extending within cable 20 to each of the four dipoles of each of sub-arrays 14, 16, 18, as will be further described.

With respect to the phase and amplitude of signals, the excitation arrangement, and particularly signal splitter/phasing unit 26, is configured to provide omnidirective phase-progressive excitation of each sub-array, via signals of equal amplitude and 90 degree phase differential coupled to the four dipoles of a sub-array. However, on a sub-array to sub-array basis, excitation is formatted so that (i) the middle sub-array 16 has phase-progressive excitation of reference amplitude and phase, (ii) the lower sub-array 14 has phase-progressive excitation of nominally 70 percent amplitude and plus 90 degree phase rotation relative to the reference amplitude and phase (i.e., relative to the middle sub-array 16), and (iii) the upper sub-array 18 has phase-progressive excitation of nominally 70 percent amplitude and minus 90 degree phase rotation relative to the reference amplitude and phase. Thus, while the omnidirective phase-progressive excitations of the lower and upper sub-arrays are of lower power and are rotated respectively plus and minus 90 degrees relative to the middle sub-array, within a sub-array the four dipoles are equally excited with dipole-to-dipole 90 degree phase differentials. As used herein, the word "nominally" is defined as covering a range of plus or minus fifteen percent from a stated value or relationship.

Figure 2:
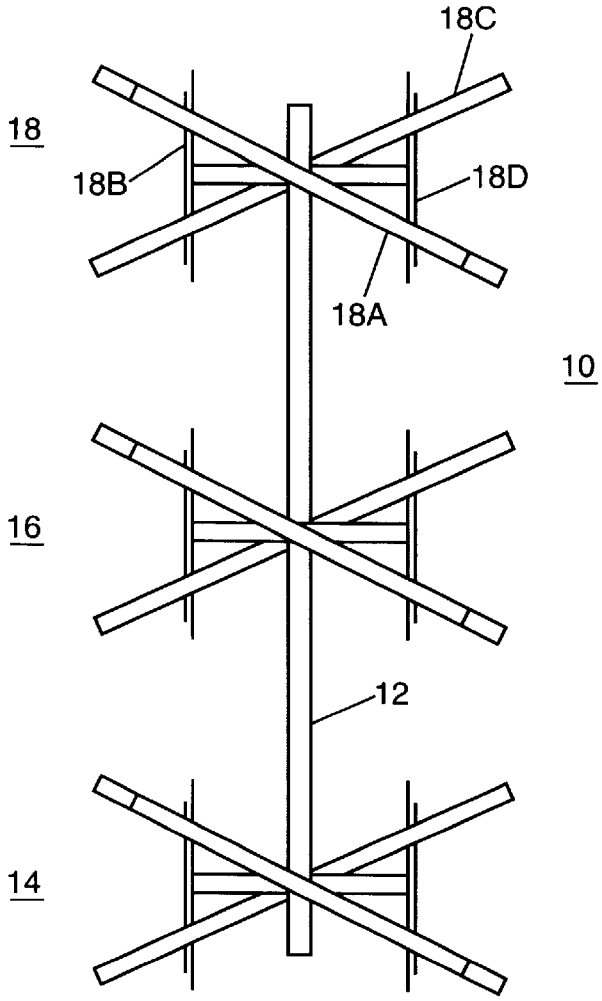
FIGS. 2 and 3 are respectively side and top views of the FIG. 1 antenna.
Figure 3:
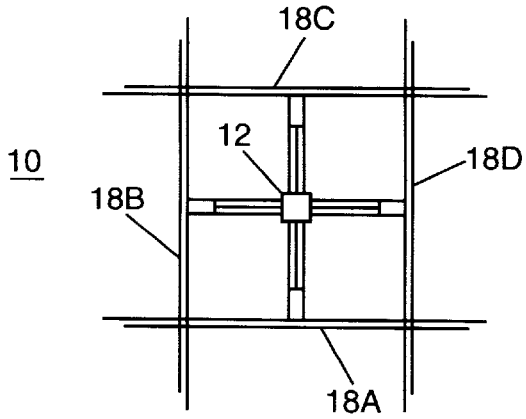

FIGS. 2 and 3 are respectively side and plan views of the FIG. 1 vertical array antenna 10, shown without external elements of the excitation arrangement. As illustrated, in this configuration mast 12 is a rectangular aluminum mast supporting dipoles aligned along lines inclined at 25 degrees. The dipole arms, which are long enough so the outward extensions of adjacent arms would physically intersect and interfere with each other if the dipoles were horizontally aligned, pass each other unobstructed as a result of the inclined positioning.

Figure 4:
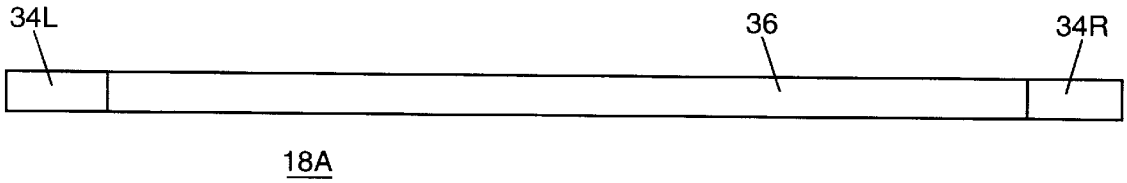
FIGS. 4 and 5 are respectively front and top views of a single dipole formed by cut-and-bend techniques from two strips of sheet metal.
Figure 5:
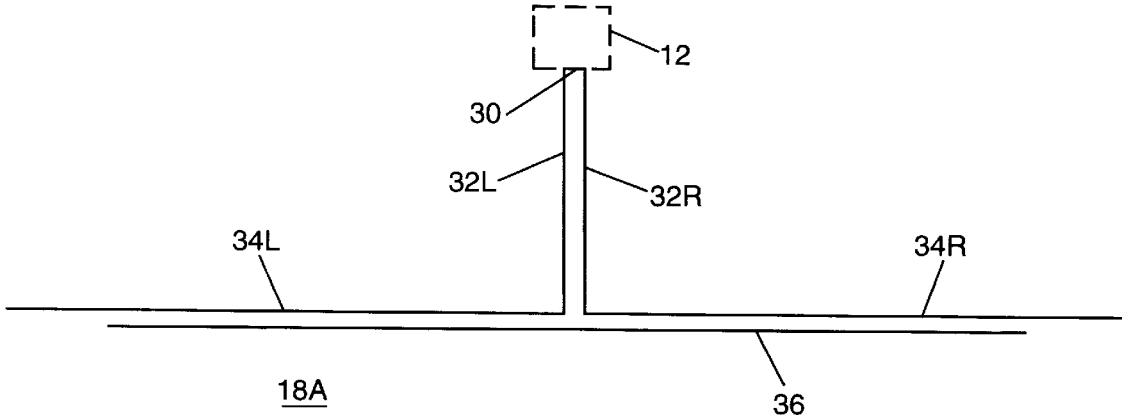
Figure 6:
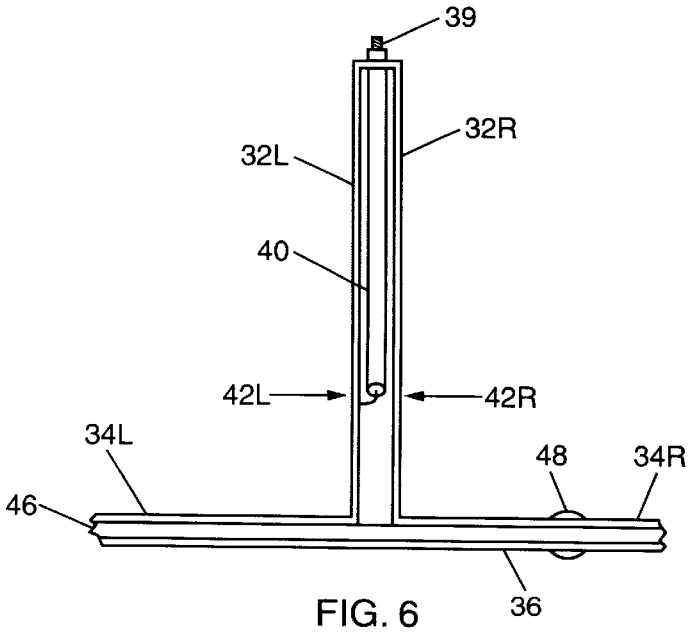
FIG. 6 is an enlarged representation of the central portion of the FIG. 5 dipole showing feed line attachment.

FIGS. 4 and 5 are front and plan views which illustrate further details of a presently preferred form of the basic structure of individual dipoles of the FIG. 1 antenna (e.g., dipole 18A). As shown in FIG. 5, dipole 18A includes left and right conductive strips or members, which in the assembled array antenna would extend horizontally outward from mounting portion 30 attached to the mast 12 (shown in dashed outline). The left and right L-shaped strips include (i) respective left and right parallel portions 32L and 32R extending outward from mounting portion 30 in parallel spaced adjacent relation, and (ii) left and right arm portions 34L and 34R extending laterally from the respective parallel portions 32L and 32R and oppositely from each other. When mounted to mast 12, the arm portions 34L and 34R also extend diagonally to horizontal as shown in FIG. 2. The dipole of FIGS. 4 and 5 also includes a conductive frontal strip or member 36 extending in parallel spaced adjacent relation to a portion of the combined length of the left and right arm portions 34L and 34R. In this embodiment, the basic dipole of FIGS. 4 and 5 may be constructed of two strips cut from aluminum sheet stock. The first strip comprises the series combination of arm portion 34L, parallel portion 32L, mounting portion 30, parallel portion 32R and arm portion 34R. After cutting the continuous strip, the parallel portions are bent normal to the mounting portion 30 and the arm portions 34L and 34R are bent normal to the parallel portions. The second strip comprises the frontal strip 36. Frontal strip 36, which in preferred embodiments is shorter than (i.e., nominally 80 percent of) the overall length of the arm portions, is supported in a centered position in front of the arm portions. Support may be provided by dielectric material, as by bonding to foam type material or use of dielectric bolts as represented in FIG. 6. In other embodiments, the left and right conductive L-shaped strips may be formed separately and attached to mast 12 in the configuration shown or variations thereof. As will be described further, the positioning and dimensioning of frontal strip 36 are effective to provide a frontal divided transmission line structure utilized to provide double-tuned operation.

Referring now to FIG. 6, there is shown an expanded representation of the central portion of the dipole of FIG. 5. As illustrated, a transmission line section 40, shown as a section of 50 ohm coaxial cable, extends from a coaxial connector 39 mounted in an opening in mounting portion 30 and continues between the parallel portions 32L and 32R. As represented in FIG. 6, the inner conductor of cable 40 is connected at a point 42L along the left parallel portion 32L and the outer conductor is connected at a point 42R along the right parallel portion 32R. By positioning points 42L and 42R at locations selected to provide a 50 ohm impedance characteristic, effective excitation of the dipole can be provided. Objectives of overall simplicity and low cost of production are thereby accomplished. Dielectric material comprising foam strip 46 or bolt 48, or other suitable configuration, may be employed to mount frontal strip 36 to the front of arm portions 34L and 34R.

With this design, the dipoles provide very low VSWR performance over a 108 to 118 MHZ VHF band. This performance is achieved via a double-tuned design whereby frequency characteristics of the basic dipole structure effectively provide a first circuit tuned within the operating band. Frontal strip 36, in combination with the transmission line section formed by parallel portions 32L and 32R, provides a second circuit similarly tuned. Considering the top views of FIGS. 5 and 6, the active length of the initial transmission line section, formed by parallel portions 32L and 32R extending outward beyond points 42L and 42R, is not long enough to provide a transmission line of length adequate for the desired tuning. However, with frontal strip 36 positioned as shown, that initial transmission line section effectively divides and forms left and right extensions in opposite directions along the front of arm portions 34L and 34R to the respective ends of frontal strip 36. For this purpose, the frontal divided transmission line structure may be configured to provide left and right extensions each having a characteristic impedance twice that of the transmission line section formed between parallel portions 32L and 32R. Alternatively, if such left and right extensions are not configured to provide such characteristic impedance, the length of parallel portions 42L and 42R can be selected to provide appropriate tuning. With this construction, the described initial transmission line section, together with the two divided transmission line sections, effectively provides the second tuned circuit. Thus, the lengths of frontal strip 36 and the parallel portions 42L and 42R may be adjusted to determine the total effective transmission line length and thereby provide the desired double-tuned, low VSWR performance. VSWR performance with this novel construction is illustrated in FIG. 10.

In an array antenna design currently considered to represent an optimum design for present DGPS applications, on the basis of performance, reliability, cost, etc., construction details are as follows. Frontal strip 36, width 2 inches and length 44 inches, spaced 0.5 inch from dipole arm portions. Parallel portions 32L and 32R and arm portions 34L and 34R, width 2 inches. Arm portions 34L and 34R, end-to-end length 53.6 inches. Parallel portions 32L and 32R, length 11 inches extending from the side of a 4 inch square mast and spaced apart 1 inch laterally. Connection points 42L and 42R, spaced 8 inches from the side of the mast. Vertical spacing between sub-arrays approximately 3.5 feet. It will be understood that the drawings are not necessarily to scale, dimensions having been distorted for clarity of illustration.

Figure 7:
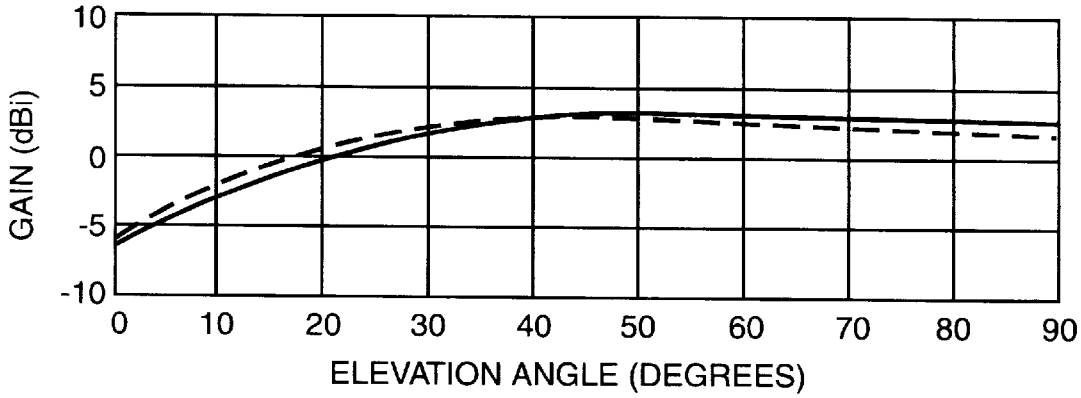
FIG. 7 shows computer generated gain v elevation data for 108 and 118 MHZ.
Figure 8:
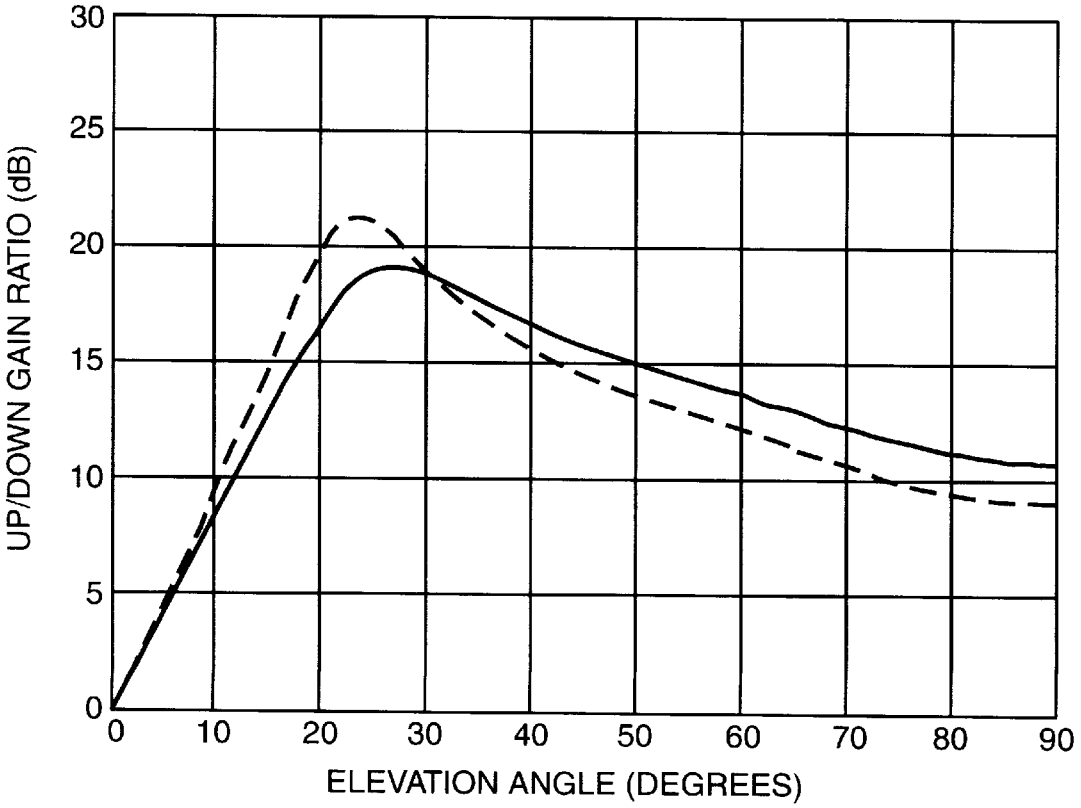
FIG. 8 shows computer generated up/down ratio v elevation data for 108 and 118 MHZ.
Figure 9:
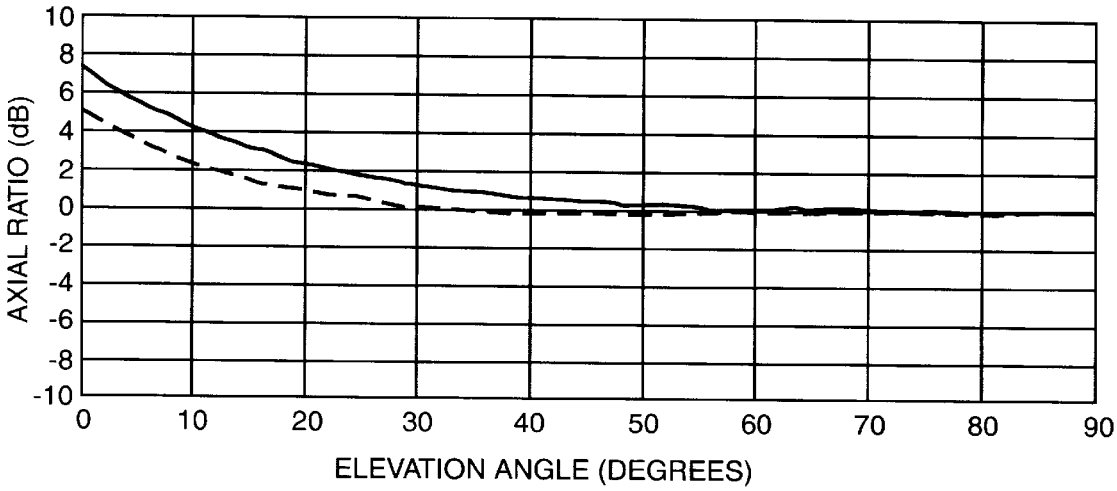
FIG. 9 shows computer generated axial ratio v elevation angle data for 108 and 118 MHZ.
Figure 10:
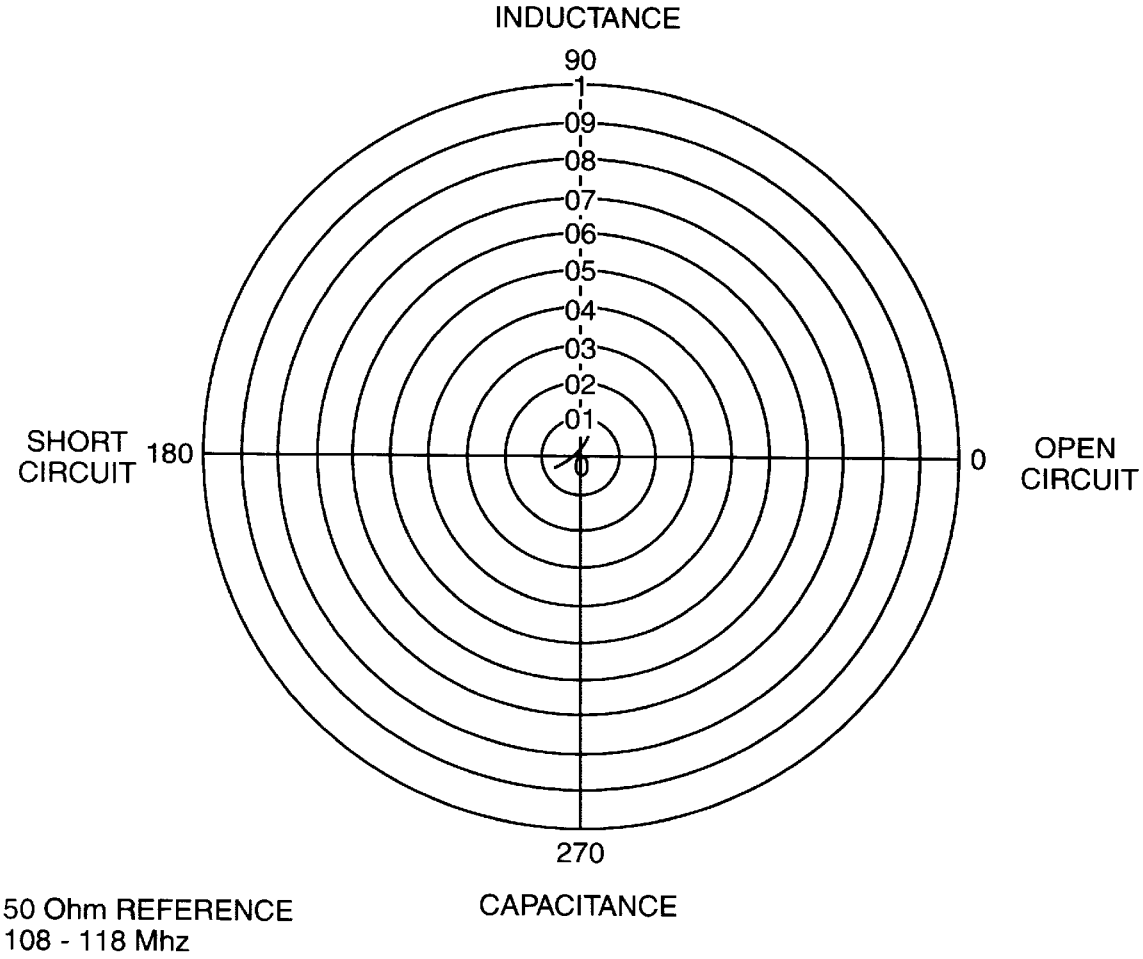
FIG. 10 shows computer generated reflection locus data representative of VSWR over the 108 to 118 MHZ band.

With this construction, performance based upon computer analysis is illustrated in FIGS. 7 through 10. FIG. 7 shows gains of about −3 dBi at 10 degrees elevation, 0 dBi at 20 degrees and 3 dBi at 50 degrees, for 108 MHz, shown as a solid line, and 118 MHz, shown as a dashed line. FIG. 8 shows an up/down gain ratio greater than 7 dB and FIG. 9 shows an axial ratio of less than 5 dB, over that elevational range with 108 MHz data represented by solid lines and 118 MHz data represented by dashed lines. FIG. 10 shows a single element reflection locus having a VSWR value of less than 1.5 to 1 over the 108–118 MHz band.

There has been described an embodiment of the invention providing excellent performance and construction which is both economical and simple, so as to enhance long term reliability. While there have been described the currently preferred embodiments of the invention, those skilled in the art will recognize that other and further applications and modifications may be made without departing from the invention and it is intended to claim all modifications and variations as fall within the scope of the invention.

What is claimed is:

1. A vertical array antenna, including a plurality of four-dipole sub-arrays, comprising:

a support mast aligned vertically;

lower, middle and upper sub-arrays, each including four dipoles extending from the mast at 90 degree azimuth separations, each dipole comprising:

(a) left and right conductive L-shaped strips having (i) respective left and right parallel portions extending outward from the mast in parallel spaced adjacent relation and (ii) left and right arm portions extending laterally from the respective parallel portions, oppositely from each other and diagonally to horizontal, and (b) a conductive frontal strip extending in parallel spaced adjacent relation to a portion of the combined length of said left and right arm portions to form a frontal divided transmission line structure; and an excitation arrangement coupled to intermediate points along the parallel portions of the L-shaped strips of each dipole to provide omnidirective phase-progressive excitation of each sub-array, with (i) said middle sub-array having phase-progressive excitation of reference amplitude and phase, (ii) said lower sub-array having phase-progressive excitation of nominally 70 percent amplitude and plus 90 degrees phase rotation relative to said reference amplitude and phase, and (iii) said upper sub-array having phase-progressive excitation of nominally 70 percent amplitude and minus 90 degree phase rotation relative to said reference amplitude and phase.

2. A vertical array antenna as in claim 1, wherein the left and right arm portions of each dipole are aligned along a line diagonally inclined at an angle of nominally 25 degrees to horizontal, to provide an elliptical phase-progressive omnidirective radiation pattern.

3. A vertical array antenna as in claim 1, wherein the frontal strip of each dipole extends linearly in front of a portion of the combined length of the arm portions of the dipole and is centered relative to said combined length, to provide a frontal divided transmission line structure with length determined by frontal strip length for purposes of double-tuned operation.

4. A vertical array antenna as in claim 1, wherein the frontal strip of each dipole is a flat strip of sheet metal and each L-shaped strip is cut from sheet metal and bent so the arm portion thereof is normal to the parallel portion thereof.

5. A vertical array antenna as in claim 4, wherein the frontal strip of each dipole is supported from the left and right arm portions of the dipole by dielectric material.

6. A vertical array antenna as in claim 1, wherein the excitation arrangement comprises 12 individual transmission line sections, each coupled to said intermediate points of a different dipole and a coupling unit to couple signals of equal amplitude and 90 degree phase differential to each of the four dipoles of each sub-array via the transmission line sections, with the signals as coupled to the lower and upper sub-arrays formatted to provide the stated relative amplitude and phase rotations.

7. A dipole array, comprising:

a support mast aligned vertically;

a plurality of dipoles extending from the mast at successive azimuth separations, each said dipole comprising:

(a) left and right conductive L-shaped members having (i) respective left and right parallel portions extending outward from the mast in parallel adjacent relation and (ii) left and right arm portions extending laterally from the respective parallel portions, oppositely from each other and diagonally to horizontal, and (b) a conductive frontal member extending in parallel adjacent relation to a portion of the combined length of said left and right arm portions to form a frontal divided transmission line structure; and four transmission line sections, each extending from the mast to a different dipole and connected to points along the left and right parallel portions of the dipole.

8. A dipole array as in claim 7, wherein the left and right arm portions of each dipole are aligned along a line diagonally inclined at an angle of nominally 25 degrees horizontal, to provide an elliptical phase-progressive radiation pattern.

9. A dipole array as in claim 7, wherein the frontal member of each dipole extends linearly in front of a portion of the combined length of the arm portions of the dipole and is centered relative to said combined length, to provide a frontal divided transmission line structure with length determined by frontal strip length for purposes of double-tuned operation.

10. A dipole array as in claim 7, wherein the frontal member of each dipole is a flat strip of sheet metal and each L-shaped member is cut from sheet metal and bent so the arm portion thereof is normal to the parallel portion thereof.

11. A dipole array as in claim 7, wherein the frontal member of each dipole is supported from said oppositely extending left and right arm portions of the dipole by dielectric material.

12. A vertical array antenna comprising:

a support mast aligned vertically;

lower, middle and upper dipole arrays, each as specified in claim 7 supported at successive spaced positions along the mast.

13. A cut-and-bend dipole comprising:

a first L-shaped conductive strip having a first portion extending from a mounting portion outward and an arm portion bent normal to the first portion;

a second L-shaped conductive strip having a parallel portion extending from a mounting portion outward in parallel spaced adjacent relation to said first portion and an arm portion bent normal to the parallel portion and extending oppositely from the arm portion of the first L-shaped strip; and a conductive frontal strip extending in parallel spaced adjacent relation to a portion of the combined length of the oppositely extending arm portions;

said strips formed from sheet stock, with each L-shaped strip having a normal bend to provide an arm portion.

14. A cut-and-bend dipole as in claim 13, wherein said first and second L-shaped conductive strips are formed in one continuous strip, with the first portion and parallel portion bent normal to a common bridging section, which connects said portions and comprises said mounting portion of each L-shaped conductive strip.

15. A cut-and-bend dipole as in claim 13, wherein the frontal strip extends linearly in front of a portion of the combined length of the oppositely extending arm portions and is centered relative to said combined length, to provide a frontal divided transmission line structure with length determined by frontal strip length for purposes of double-tuning.

16. A cut-and-bend dipole as in claim 13, wherein said frontal strip is a linear strip supported in front of said arm portions by dielectric material.

17. A cut-and-bend dipole as in claim 13, additionally comprising signal feed points on said first and parallel portions between the mounting point and the respective arm portions.

18. A cut-and-bend dipole as in claim 13, wherein said strips are cut from aluminum sheet stock.

19. A dipole, having a spaced frontal conductor, comprising:

left and right arm portions extending oppositely from respective spaced adjacent parallel portions, the parallel portions configured to form a transmission line section; and the frontal conductor extending in parallel spaced adjacent relation to a portion of the combined length of the oppositely extending arm portions to form a frontal divided transmission line structure providing left and right extensions of said transmission line section which end at the ends of the frontal conductor;

the length of the frontal conductor selected to provide double-tuned operation within a predetermined frequency band.

20. A dipole as in claim 19, in which said transmission line section and said left and right extensions form a composite transmission line which functions as a tuned circuit effective, in combination with frequency characteristics of the left and right arm portions, to provide double-tuned operation.

21. A dipole as in claim 19, additionally comprising dipole feed points at a position along said parallel portions at a distance from the left and right arm portions, and wherein the effective length of said composite transmission line is represented by said distance plus one-half the length of the frontal conductor.

22. A dipole as in claim 19, wherein said frontal divided transmission line structure is configured to provide left and right extensions each having a characteristic impedance nominally twice that of said transmission line section.

* * * * *